US011040258B2

(12) United States Patent
Coe et al.

(10) Patent No.: US 11,040,258 B2
(45) Date of Patent: Jun. 22, 2021

(54) POCKET-CHANNELING LACROSSE HEAD

(71) Applicant: Wm. T. Burnett IP, LLC, Baltimore, MD (US)

(72) Inventors: John William Coe, Denver, CO (US); Austin Scott Brown, Glen Rock, PA (US)

(73) Assignee: Wm. T. Burnett IP, LLC, Baltimore, MD (US)

( * ) Notice: Subject to any disclaimer, the term of this patent is extended or adjusted under 35 U.S.C. 154(b) by 0 days.

(21) Appl. No.: 16/599,852

(22) Filed: Oct. 11, 2019

(65) Prior Publication Data

US 2020/0038725 A1 Feb. 6, 2020

Related U.S. Application Data

(63) Continuation of application No. 15/959,480, filed on Apr. 23, 2018, now Pat. No. 10,471,318.

(60) Provisional application No. 62/489,284, filed on Apr. 24, 2017.

(51) Int. Cl.
*A63B 59/20* (2015.01)
*A63B 102/14* (2015.01)

(52) U.S. Cl.
CPC ..... *A63B 59/20* (2015.10); *A63B 2102/14* (2015.10)

(58) Field of Classification Search
CPC ..... A63B 59/20; A63B 2102/14; A63B 60/00; A63B 60/46
USPC ..... 473/513
See application file for complete search history.

(56) References Cited

U.S. PATENT DOCUMENTS

| | | | |
|---|---|---|---|
| 3,507,495 | A | 4/1970 | Tucker et al. |
| 4,034,984 | A | 7/1977 | Crawford et al. |
| 5,566,947 | A | 10/1996 | Tucker et al. |
| 5,685,791 | A | 11/1997 | Feeney |
| 7,094,167 | B2 | 8/2006 | Tucker, Sr. |
| 7,407,455 | B2 | 8/2008 | Tucker, Jr. |
| 7,520,828 | B2 | 4/2009 | Tucker, Sr. et al. |
| 7,736,252 | B2 | 6/2010 | Tucker, Jr. et al. |
| 7,766,773 | B1 | 8/2010 | Gait |
| 7,815,531 | B1 | 10/2010 | Gait |

(Continued)

OTHER PUBLICATIONS

Excerpt of 2016 STX Men's and Women's Lacrosse Catalogs, 16 pages.

(Continued)

*Primary Examiner* — Eugene L Kim
*Assistant Examiner* — Rayshun K Peng
(74) *Attorney, Agent, or Firm* — Plumsea Law Group, LLC

(57) ABSTRACT

A lacrosse head configured to form a pocket channel, the lacrosse head having a stop member, first and second sidewalls extending from the stop member in a forward direction, and a scoop connecting the first sidewall and the second sidewall opposite to the stop member, with the scoop having a forward edge and a rearward edge, with the rearward edge of the scoop defining generally an arc shape except for a recessed portion disposed at a longitudinal centerline of the lacrosse head, and with the scoop defining at least one stringing hole disposed forward of the recessed portion. Alternatively, a lacrosse head may have a scoop that defines a plurality of lateral stringing holes disposed generally along an arc, and that defines a forwardly offset stringing hole disposed along a longitudinal centerline of the lacrosse head and forward of the arc.

20 Claims, 10 Drawing Sheets

(56) References Cited

U.S. PATENT DOCUMENTS

| | | | | |
|---|---|---|---|---|
| 7,896,761 | B2 | 3/2011 | Tucker, Sr. | |
| 7,955,199 | B2 | 6/2011 | Tucker, Jr. et al. | |
| 8,267,813 | B2 | 9/2012 | Vestuti et al. | |
| 8,267,814 | B1 | 9/2012 | Kohler et al. | |
| 8,852,035 | B2 | 10/2014 | Vestuti et al. | |
| 10,471,318 | B2 | 11/2019 | Coe et al. | |
| 2005/0064963 | A1* | 3/2005 | Filice ..... | A63B 49/14 473/513 |
| 2005/0064964 | A1 | 3/2005 | Filice et al. | |
| 2006/0019778 | A1 | 1/2006 | Tucker, Jr. | |
| 2006/0194655 | A1 | 8/2006 | Tucker, Sr. et al. | |
| 2006/0264277 | A1 | 11/2006 | Tucker, Jr. et al. | |
| 2008/0146387 | A1 | 6/2008 | Gait | |
| 2009/0011874 | A1 | 1/2009 | Gait | |
| 2009/0298623 | A1 | 12/2009 | Schmidt | |
| 2011/0160007 | A1* | 6/2011 | Winningham ..... | A63B 59/20 473/513 |
| 2015/0190691 | A1 | 7/2015 | Colchie | |
| 2017/0021244 | A1 | 1/2017 | Colchie | |
| 2017/0232315 | A1 | 8/2017 | Brown | |
| 2018/0304130 | A1 | 10/2018 | Coe et al. | |

OTHER PUBLICATIONS

STX Arrow Lacrosse Head—SidelineSwap web page, Jun. 6, 2014 [retrieved on May 25, 2018]. Retrieved from the Internet: <https://sidelineswap.wordpress.com/tag/stx-arrow/>.

* cited by examiner

POCKET-CHANNELING LACROSSE HEAD

This application is a continuation of U.S. application Ser. No. 15/959,480, filed Apr. 23, 2018 (U.S. Publication No. US2018/0304130, published Oct. 25, 2018), which claims the benefit of U.S. Provisional Application No. 62/489,284, filed Apr. 24, 2017, both of which are herein incorporated by reference in their entirety.

BACKGROUND

Field

The present embodiments relate generally to lacrosse equipment, and more particularly, to a lacrosse stick head having a scoop configured to form a channeled pocket.

Background

Lacrosse players favor lacrosse stick head pockets that provide control in catching, throwing, and cradling a lacrosse ball. Characteristics of a pocket that affect such performance include the shape, structure, and tension of the stringing materials. Typically, preferred pockets provide a structure that guides a ball into and out of the pocket along a centerline of the lacrosse head, for accuracy in catching and throwing.

SUMMARY

Embodiments provide a lacrosse head having a stop member, a first sidewall extending from the stop member in a forward direction, a second sidewall extending from the stop member in the forward direction, and a scoop connecting the first sidewall and the second sidewall opposite to the stop member. The scoop may have a forward edge and a rearward edge, with the rearward edge of the scoop defining generally an arc shape, except for a recessed portion disposed at a longitudinal centerline of the lacrosse head. The scoop may define at least one stringing hole disposed forward of the recessed portion.

In an aspect, the at least one stringing hole may be a center stringing hole that is disposed in the scoop aligned with the longitudinal centerline of the lacrosse head.

In another aspect, the recessed portion may provide a perimeter length of the rearward edge greater than if the rearward edge extended continuously through the arc shape.

In another aspect, the recessed portion may define a generally trapezoidal recess having a curved forward side, two lateral sides angled inwardly toward the longitudinal centerline in a rearward-to-forward direction, and an open rearward side.

In another aspect, the scoop may define a plurality of lateral stringing holes, with each of the plurality of lateral stringing holes disposed closer to the arc shape defined by the rearward edge of the scoop than the at least one stringing hole.

In another aspect, the lacrosse head may include a mesh material attached to the plurality of lateral stringing holes, the at least one stringing hole, the first sidewall, the second sidewall, and the stop member.

In another aspect, the at least one stringing hole and the recessed portion may tension the mesh material along the longitudinal centerline, along a first diagonal direction from the recessed portion to a middle portion of the first sidewall between the scoop and the stop member, and along a second diagonal direction from the recessed portion to a middle portion of the second sidewall between the scoop and the stop member, thereby forming a channeled pocket along the longitudinal centerline of the lacrosse head.

In another aspect, the mesh material may have a rectangular pre-strung shape.

In another aspect, the lacrosse head may include one or more stringing cords that attach the mesh material to the plurality of lateral stringing holes, the at least one stringing hole, the first sidewall, the second sidewall, and the stop member.

In another aspect, the at least one stringing hole may be a first stringing hole and a second stringing hole disposed generally symmetrical about the longitudinal centerline.

In another aspect, the scoop may define a raised region aligned with the longitudinal centerline, a first recessed region on one side of the raised region, and a second recessed region on an opposite side of the raised region. The first recessed region may be disposed on a side of the longitudinal centerline opposite to a side on which the second recessed region is disposed. The raised region may have a raised surface relative to the first and second recessed regions.

In another aspect, the raised region may have a first side edge, a center area, and a second side edge, and the first and second side edges may extend generally diagonally from the rearward edge of the scoop to the forward edge of the scoop in a direction toward the longitudinal centerline.

In another aspect, the first and second side edges may be raised relative to the center area.

Another embodiment provides a lacrosse head having a stop member, a first sidewall extending from the stop member in a forward direction, a second sidewall extending from the stop member in the forward direction, and a scoop connecting the first sidewall and the second sidewall opposite to the stop member. The scoop may have a forward edge and a rearward edge. The scoop may define a plurality of lateral stringing holes disposed in the scoop generally along an arc. The scoop may define a forwardly offset stringing hole that is disposed in the scoop along a longitudinal centerline of the lacrosse head and forward of the arc.

In an aspect, the rearward edge of the scoop may have an arc shape generally corresponding to the arc of the plurality of lateral stringing holes, except for a recessed portion disposed at the longitudinal centerline and adjacent to the forwardly offset stringing hole.

In another aspect, the recessed portion may provide a perimeter length of the rearward edge greater than if the rearward edge extended continuously through the arc shape.

In another aspect, the recessed portion may define a generally trapezoidal recess having a curved forward side, two lateral sides angled inwardly toward the longitudinal centerline in a rearward-to-forward direction, and an open rearward side.

In another aspect, the lacrosse head may include a mesh material attached to the plurality of lateral stringing holes, the forwardly offset stringing hole, the first sidewall, the second sidewall, and the stop member. The forwardly offset stringing hole may pull a central portion of the mesh material into the recessed portion and tension the mesh material along the longitudinal centerline, along a first diagonal direction from the forwardly offset stringing hole to a middle portion of the first sidewall between the scoop and the stop member, and along a second diagonal direction from the forwardly offset stringing hole to a middle portion of the second sidewall between the scoop and the stop member, thereby forming a channeled pocket along the longitudinal centerline of the lacrosse head.

In another aspect, the scoop may define a raised region aligned with the longitudinal centerline, a first recessed region on one side of the raised region, and a second recessed region on an opposite side of the raised region. The raised region may have a raised surface relative to the first and second recessed regions. The raised region may have a first side edge, a center area, and a second side edge, with the first and second side edges extending generally diagonally from the rearward edge of the scoop to the forward edge of the scoop in a direction toward the longitudinal centerline.

In another aspect, the forwardly offset stringing hole may be disposed approximately at a midpoint between the forward edge and the arc.

Another embodiment provides a lacrosse head having a stop member, a first sidewall extending from the stop member in a forward direction, a second sidewall extending from the stop member in the forward direction, a scoop connecting the first sidewall and the second sidewall opposite to the stop member, and a mesh material. The scoop may have a forward edge and a rearward edge. The rearward edge of the scoop may define a recessed portion that is disposed at a longitudinal centerline of the lacrosse head and is recessed with respect to a first lateral portion of the rearward edge on a first side of the longitudinal centerline and a second lateral portion of the rearward edge on a second side of the longitudinal centerline opposite to the first side. The scoop may define at least one offset stringing opening disposed forward of the recessed portion, a first lateral stringing opening disposed laterally beyond the recessed portion and adjacent to the first lateral portion of the rearward edge, and a second lateral stringing opening disposed laterally beyond the recessed portion and adjacent to the second lateral portion of the rearward edge. The mesh material may be attached to the at least one offset stringing opening, to the first lateral stringing opening, to the second lateral stringing opening, to the first sidewall, to the second sidewall, and to stop member. The attachment of the mesh material to the at least one offset stringing opening may pull a central portion of the mesh material more forward of remaining forward portions of the mesh material that are attached to the first and second lateral stringing openings, and tension the mesh material in a longitudinal direction from the scoop to the stop member, in a first diagonal direction from the recessed portion to the first sidewall, and in a second diagonal direction from the recessed portion to the second sidewall, thereby forming a channel in the mesh material.

BRIEF DESCRIPTION OF THE DRAWINGS

The embodiments can be better understood with reference to the following drawings and description. The components in the figures are not necessarily to scale, emphasis instead being placed upon illustrating the principles of the embodiments. Moreover, in the figures, like reference numerals designate corresponding parts throughout the different views.

and

Figure 10:
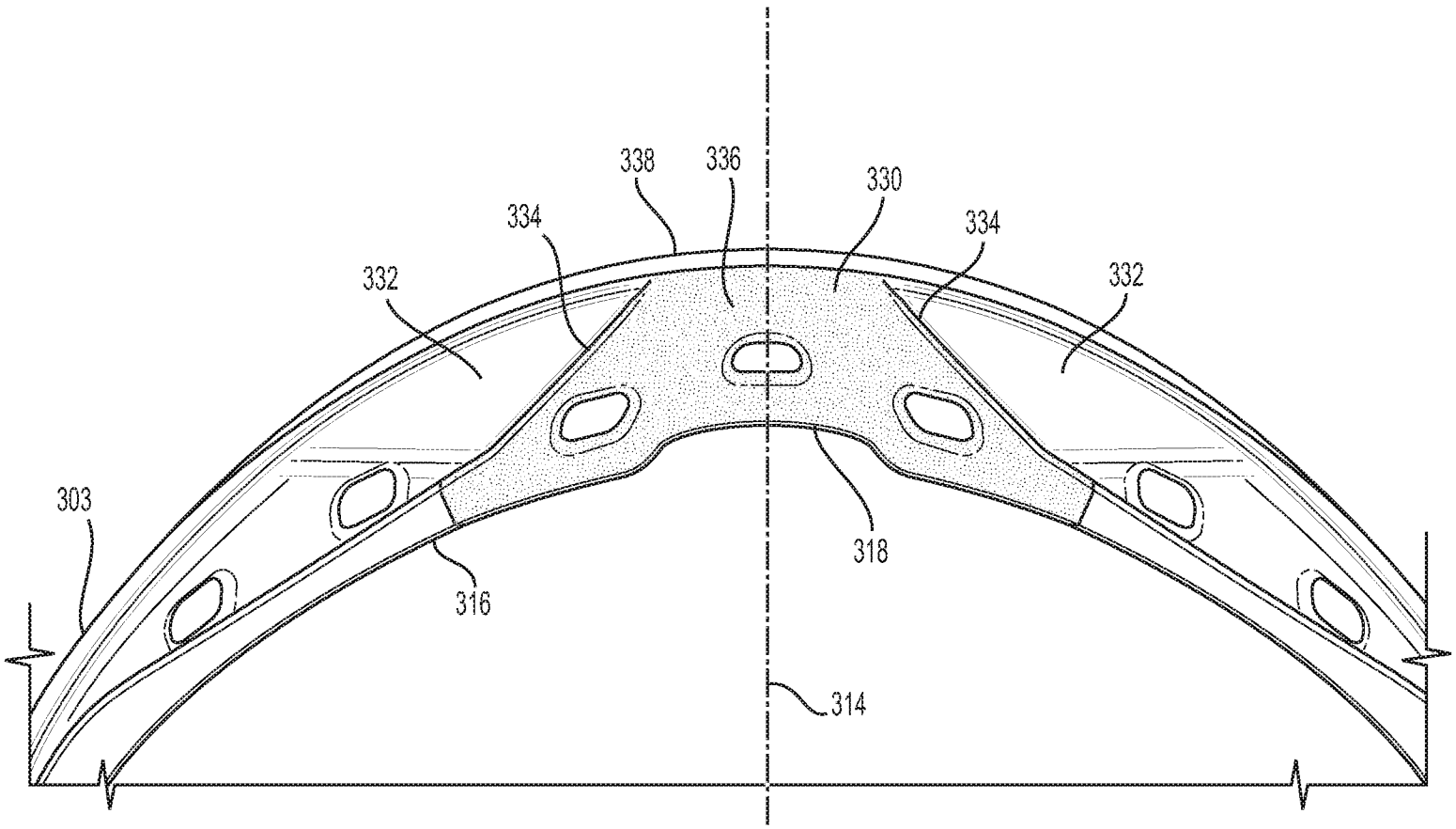

FIG. 10 is a schematic diagram that illustrates a scoop having a raised region, according to an embodiment.

DETAILED DESCRIPTION

Embodiments provide a lacrosse stick head having a scoop configured to form a channeled pocket, for example, along a longitudinal centerline of the lacrosse head.

Figure 1:
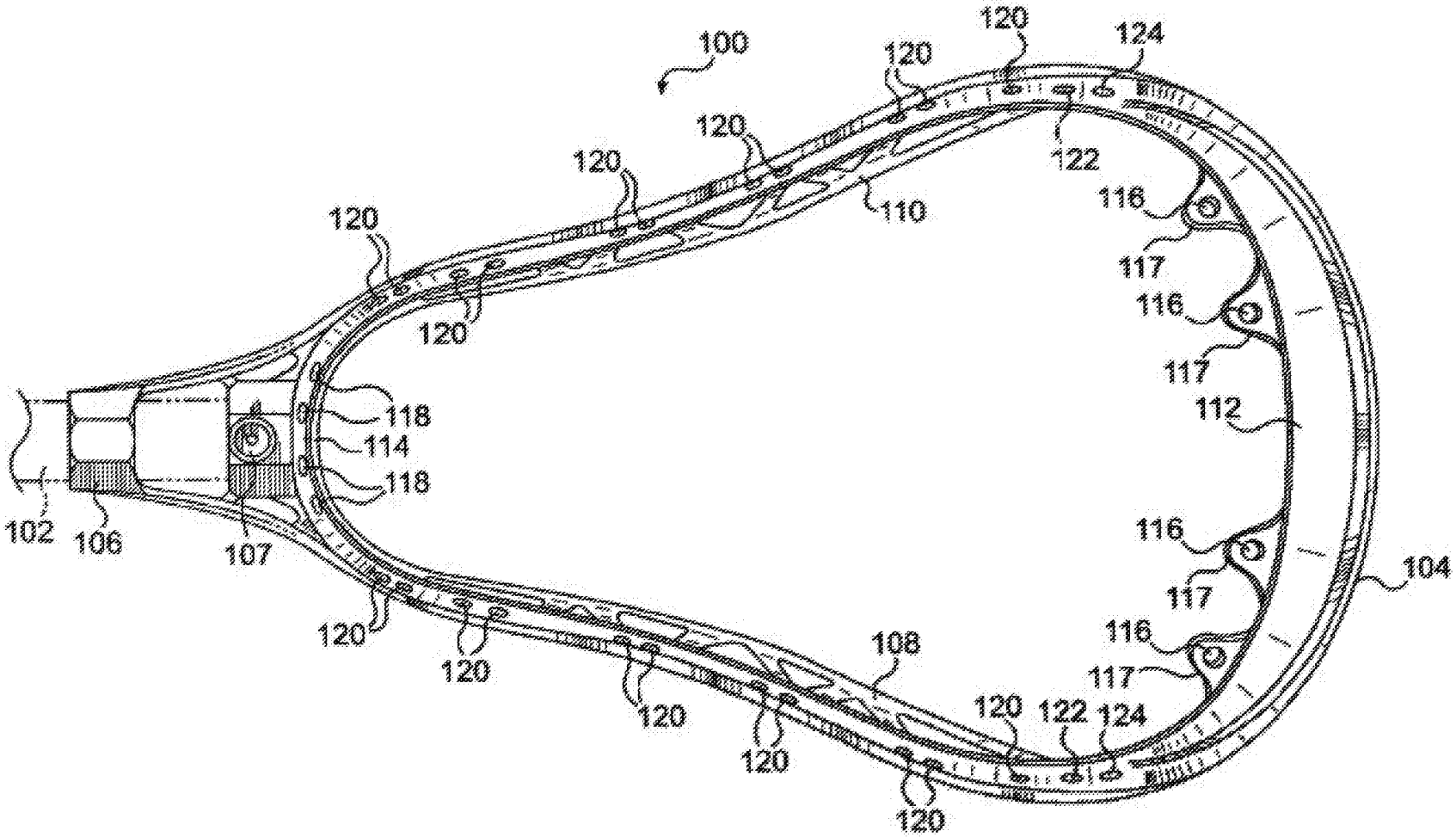
FIG. 1 is a schematic diagram of a double-wall synthetic lacrosse head.

FIG. 1 illustrates components of a lacrosse stick 100, including a handle 102 shown in dotted lines and a double-wall synthetic head 104. Head 104 may have a generally V-shaped frame having a juncture 106, sidewalls 108 and 110, a transverse wall (or "scoop") 112 joining the sidewalls at their ends opposite juncture 106, and a stop member 114 joining sidewalls 108 and 110 at their ends nearest juncture 106. The frame may be considered to extend from a rearward end at the juncture 106 to a forward end at the scoop 112. As shown, handle 102 may fit into and through juncture 106, and may abut stop member 114. A screw or other fastener may be placed through opening 107, securing handle 102 to head 104. Features of a lacrosse stick are shown generally in Tucker et al., U.S. Pat. No. 3,507,495, Crawford et al., U.S. Pat. No. 4,034,984, and Tucker et al., U.S. Pat. No. 5,566,947, which are all incorporated by reference herein.

Lacrosse stick heads, such as the one shown in FIG. 1, may have a "traditional" pocket configuration or a "mesh" pocket configuration. The traditional pocket may include thongs made of leather or synthetic material strung from upper thong holes in transverse wall 112 to lower thong holes in stop member 114. To complete the pocket web, the thongs may have nylon strings threaded around the thongs and string laced through stringing holes in sidewalls 108 and 110, forming any number of diamonds (crosslacing).

In traditional pockets, thongs (not shown) made of leather or synthetic material may extend from upper thong holes 116 in transverse wall 112 to lower thong holes 118 in stop member 114. Upper thong holes 116 may be located on tabs 117 of the scoop 112 as shown in FIG. 1. Alternatively, upper thong holes 116 may be located directly on the scoop 112. FIG. 1 shows four pairs (116, 118) of thong holes that accept four thongs. To complete the pocket web, nylon strings may be threaded around the thongs and string may be laced through stringing holes 120 in sidewalls 108 and 110, forming any number of diamonds (crosslacing). Finally, one or more throwing or shooting strings may extend transversely between the upper portions of sidewalls 108 and 110, attaching to throwing stringing holes 124 and a string laced through stringing holes 122.

As used herein, stringing holes or stringing openings refer to the openings that receive the various forms of pocket stringing, such as the holes in the scoop, sidewalls, and stop members, or the openings in tabs attached to the scoop, sidewalls, and stop members. The terms "holes" and "openings" should be construed broadly so as to encompass any structure that retains the pocket stringing, including structures such as hooks, which may be considered to define openings to receive the pocket stringing. Also, as used herein, a pocket thread refers to any member, such as a thong, string, or mesh, that forms the pocket and/or attaches the pocket to the lacrosse head.

A mesh pocket configuration may use a mesh knitted as a continuous piece of material. This continuous piece of material may attach to the lacrosse head as a single unit. The mesh may be attached to the lacrosse head using transverse lacing, which may reinforce the web of the mesh that is adjacent to the lacrosse head.

Figure 2:
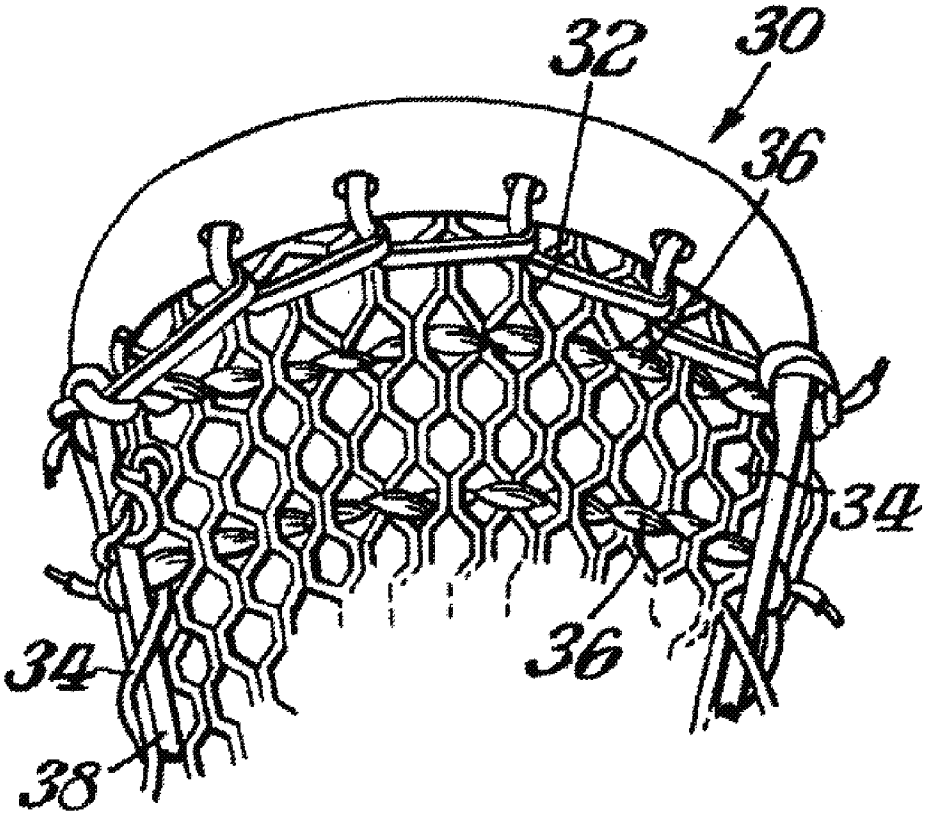
FIG. 2 is a schematic diagram of a portion of a lacrosse stick head having a mesh pocket with throwing strings.

FIG. 2 illustrates an example of a mesh pocket 30. Rather than the longitudinal thongs and open weave lacing of the traditional pocket, the mesh pocket may use a mesh knitted as a continuous, uniform design of woven material having a plurality of openings (e.g., mesh diamonds or mesh hexagons) provided therein. The mesh openings may be uniform if the openings are all of the same size. The mesh may have a rectangular pre-strung shape. The mesh may be peripherally coupled to the head of the lacrosse stick by a single stringing cord, by multiple stringing cords, or by other binding materials (e.g., hook and loop fasteners). As shown in FIG. 2, a mesh pocket 30 may include a central mesh portion 32 and open weave lacing 34 interconnecting mesh portion 32 to side walls 38 of the head frame.

Mesh pockets may include one or more "throwing strings" or "shooting strings" extending transversely between the upper portions of sidewalls 108 and 110, proximate scoop 112 (see FIG. 1). FIG. 2 shows transverse throwing strings 36 interwoven between the mesh openings. In addition to supporting the pocket stringing, the throwing strings may prevent the thrown ball from traveling too far up the pocket assembly and striking the scoop, which can cause inaccurate passing and shooting. Thus, throwing strings may be intended to be the point of departure of a thrown ball. Players may use one or more throwing strings in a variety of locations and positions in the pocket to fine-tune and adjust their pocket to suit their style of play in catching, cradling, and throwing the ball.

Mesh pockets may be entirely formed from either a "soft mesh" or a "hard mesh," each having its own performance characteristics. Soft mesh pockets may be more pliable and forgiving than hard mesh pockets, which enhances pocket formation and ball retention. Examples of materials from which soft mesh pockets may be made include nylon, polyester, and combinations thereof. Soft mesh pockets may require little, if any, break-in and readily form a deeper, less structured pocket from which a ball is more difficult to dislodge. This less structured pocket, however, may also make it more difficult to shoot and pass. As the ball rolls from the stop member of the head toward the scoop, the soft mesh's tendency to sag may hamper the release of the ball.

While interweaving shooting strings across the mesh can reduce this sagging effect, the soft mesh may still not support the heavy lacrosse ball, allowing the ball to get caught under (or being impeded rather than assisted by) the throwing strings. In addition, the throwing strings add another stringing member to the pocket, which adds weight to the lacrosse head and increases the time and effort needed to maintain the pocket. The traditional throwing string materials also may tend to rot, break, crack, wear out, absorb water, and stretch due to weather conditions and the constant wear and tear of catching and throwing a lacrosse ball. In addition, the traditional throwing strings may be difficult to adjust since they may require the loosening of knots made to hold them in place and a tedious adjustment process along the portions of the throwing strings that are interwoven among the mesh openings.

In contrast to soft mesh pockets, hard mesh pockets may be stiffer and firmer, and made of, for example, a combination of materials such as nylon or polyester threads coated with a stiffening material such as urethane. The stiffening material may harden the threads and prevent the threads from absorbing moisture. The hard mesh may address some of the throwing accuracy drawbacks of soft mesh pockets by providing a ball release surface that is firmer and more supportive. In addition, the stiffening material may help prevent possible moisture damage to the pocket, e.g., causing stretching or shrinking. Forming the pocket of hard mesh, however, may make it more difficult to catch and retain the ball in the pocket. A hard mesh pocket also may require a period of break-in to form the pocket. In addition, because the harder mesh may retain its shape so well, ball dislodgement may be easier.

Figure 3:
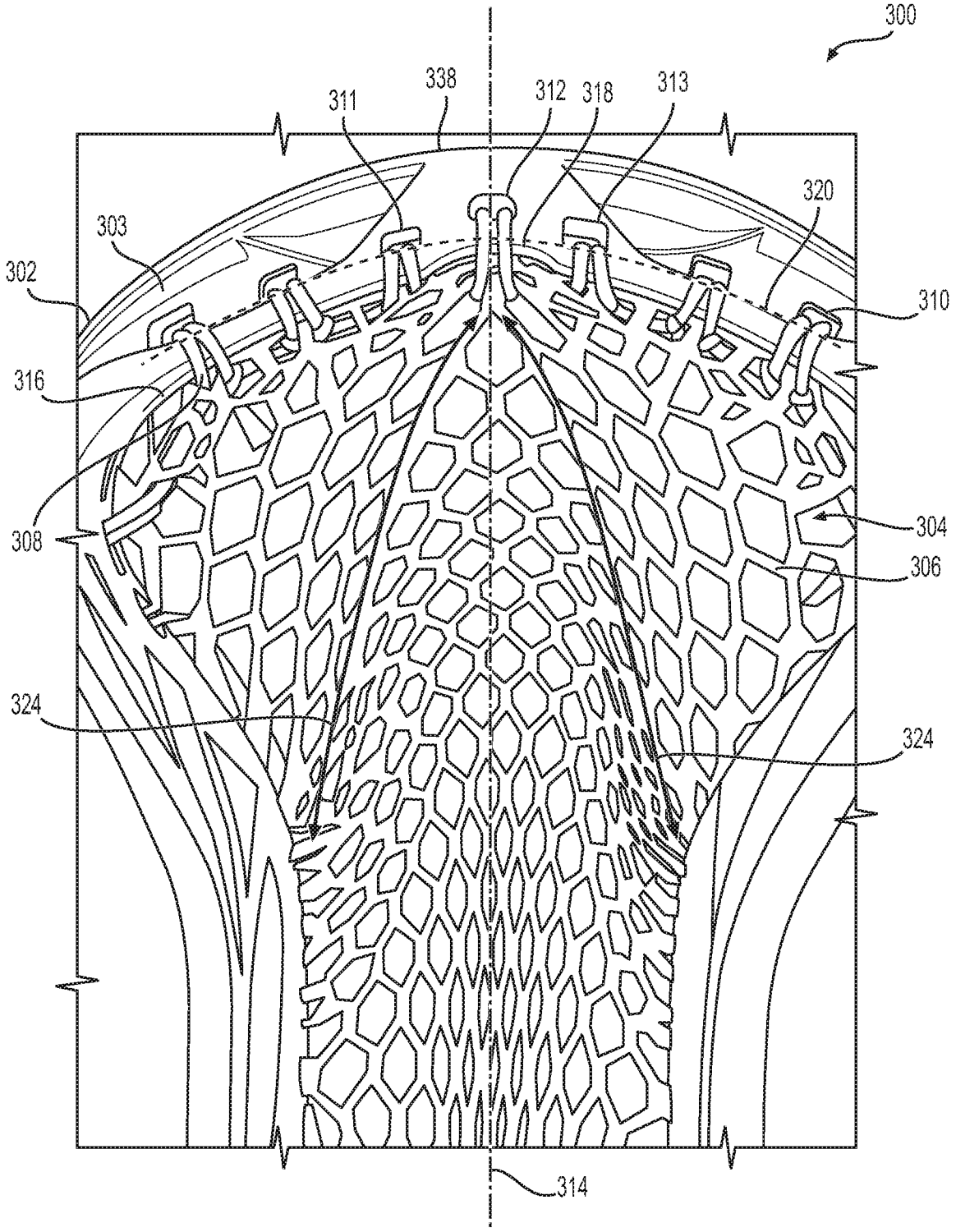
FIGS. 3-5 are schematic diagrams that illustrate an embodiment of a lacrosse stick head configured to provide a channeled pocket.

FIG. 3 illustrates an embodiment of a lacrosse stick head 300 configured to provide a channeled pocket. As shown, lacrosse stick head 300 may have a frame 302 and a mesh pocket 304. Mesh pocket 304 may include a mesh material 306 joined to the frame 302 by one or more stringing cords 308. The scoop 303 of frame 302 may define stringing holes 310 through which the one or more stringing cords 308 may be threaded and fastened to frame 302. Stringing holes 310 in the scoop 303 may be disposed generally along an arc 320 except for an offset stringing hole 312, which may be offset in a forward direction with respect to the arc 320 along which the remaining stringing holes are disposed. As used herein, "arc" may refer to a part of a curve. Offset stringing hole 312 may also be generally aligned with a longitudinal centerline 314 of the lacrosse stick head 300. The remaining stringing holes, such as holes 311 and 313, may be disposed to the side of the longitudinal centerline 314, and may be referred to herein as lateral stringing holes.

Figure 4:
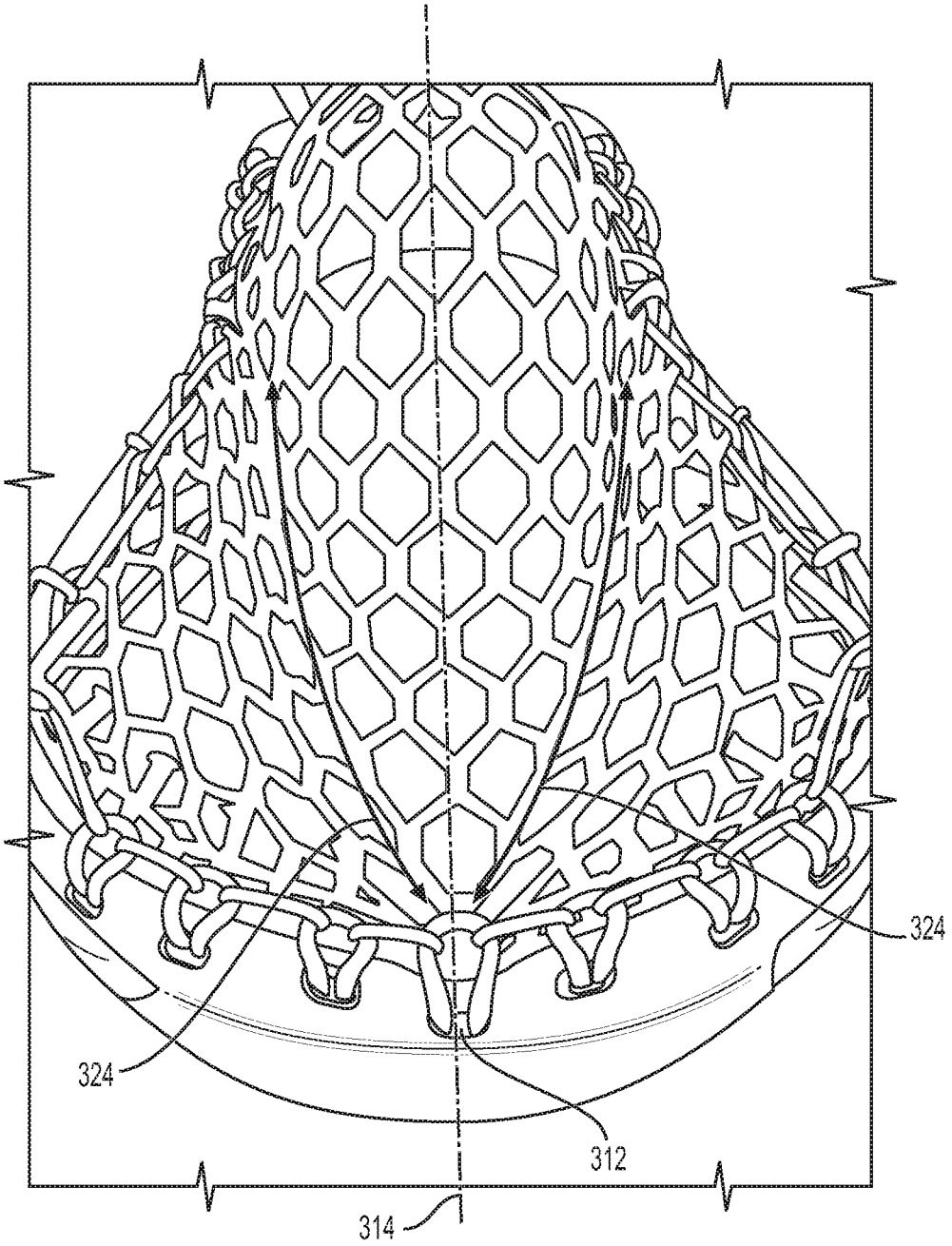
Figure 5:
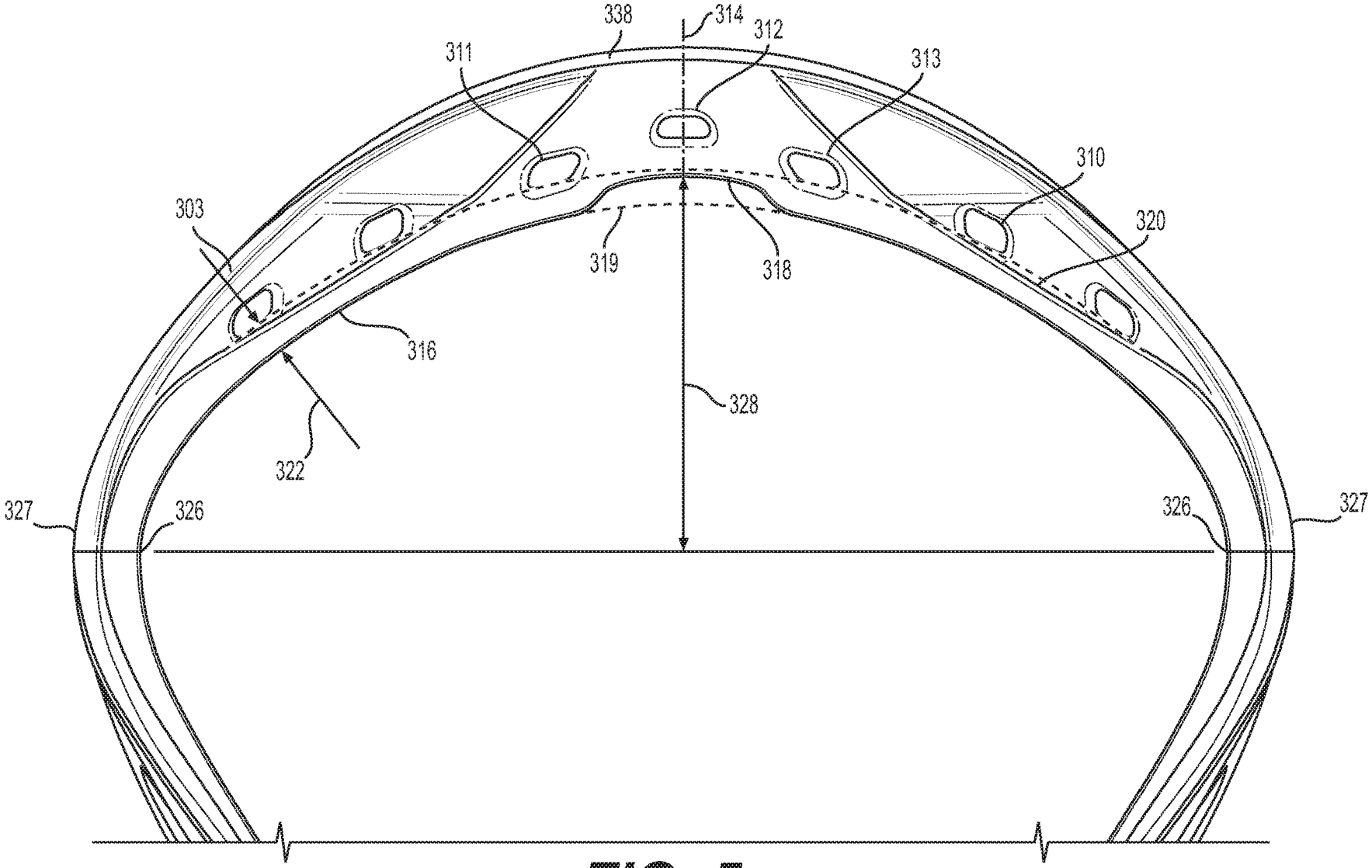

As shown in FIGS. 3-5, a rearward edge 316 of the scoop 303 may have an arc shape substantially similar to the arc 320 on which the remaining stringing holes are disposed, except for a forwardly recessed portion 318 (or "notched") disposed adjacent to the offset stringing hole 312 and generally aligned with the longitudinal centerline 314 of the lacrosse stick head 300. As shown, recessed portion 318 may be shaped as generally a trapezoid, with the edges of the recessed portion 318 defining a generally trapezoidal recess having a curved forward side, two lateral sides angled inwardly toward the longitudinal centerline 314 in a rearward-to-forward direction, and an open rearward side. A trapezoidal shape may lead to surprising benefits in providing room into which to pull portions of mesh pocket 304 and form in mesh pocket 304 a channel of a shape conducive to ball travel, and in providing a geometry more susceptible to manufacturing, e.g., by injection molding.

Although in the embodiment of FIG. 5 the trapezoidal recess has curved aspects, other embodiments may provide a recess that is shaped as a precise trapezoid with four straight sides, two of which are parallel. Alternatively, recessed portion 318 may have another generally polygonal shape (e.g., triangle, rectangle, or square) or may be curved (e.g., semicircular or semi-oval). Notwithstanding the benefits of the particular shape of the recessed portion 318 depicted in the figures, a recessed portion may be any shape that increases the perimeter length of a rearward edge of a scoop.

In embodiments, the stringing holes 310, including the offset stringing hole 312, may each be disposed a roughly equal distance 322 from the rearward edge 316 of the scoop 303. As shown in FIG. 5, lateral stringing holes 311 and 313 may be disposed beyond the recessed portion 318, relative to the arc 320, and adjacent to the rearward edge 316 of the scoop 303.

As shown in FIG. 5, in embodiments, forwardly offset stringing hole 312 may be disposed in scoop 303 along longitudinal centerline 314 and at an approximate midpoint between forward edge 338 and the continuous arc shape defined by rearward edge 316, represented by broken line 319. In other embodiments, forwardly offset stringing hole 312 may be disposed in scoop 303 along longitudinal centerline 314 and at an approximate midpoint between forward edge 338 and arc 320.

In embodiments, the forwardly offset stringing hole 312 and forwardly recessed portion 318 may pull and form the mesh material 306 to create a channeled pocket structure. For example, as shown in the front view of FIG. 3 and the bottom view of FIG. 4, the offset stringing hole 312 may pull a row of openings in the mesh material 306 along the longitudinal centerline 314 and a farther distance forward than remaining rows of openings, such as those attached to the nearest non-offset lateral stringing holes 311 and 313. In addition, the forwardly recessed portion 318 of the rearward edge 316 of the scoop 303 may provide additional space in which to pull the one or more stringing cords 308 and the mesh material 306. In other words, the recessed portion 318 may create additional perimeter or arc length across which the mesh material 306 is stretched. This pull on the mesh material 306 may create tension in generally three directions, one direction along the longitudinal centerline 314 and two generally diagonal directions 324 from the offset stringing hole 312 to a middle portion of each sidewall, as shown in FIGS. 3-4. Those three directions of tension, which may be collectively referred to as a V-shaped zone of tension, may create a channeled pocket. Beneficially, forwardly recessed portion 318 may extend a pocket channel in the direction of ball release as in a glide path, which may enhance ball control during throwing.

In embodiments, referring to FIGS. 3-4, a method for forming a channeled lacrosse head pocket may include attaching a central portion of a mesh material 306 to at least one offset stringing hole 312 disposed forward of a recessed portion 318 that is defined in the rearward edge 316 of the scoop 303 and is aligned with a longitudinal centerline 314 of the head 300. The method may further include attaching a first lateral portion of the mesh material 306 to a first lateral stringing hole 311 that is defined in the scoop 303 lateral to the longitudinal centerline 314 and the recessed portion 318 on a first side of the longitudinal centerline 314, and is rearward of the offset stringing hole 312. The method may further include attaching a second lateral portion of the mesh material 306 to a second lateral stringing hole 313 that is defined in the scoop 303 lateral to the longitudinal centerline 314 and the recessed portion 318 on a second side of the longitudinal centerline 314 opposite to the first side, and is rearward of the offset stringing hole 312. The method may further include pulling the central portion of the mesh material 306 farther forward than the first and second lateral portions of the mesh material 306, and into the recessed portion 318, to form a channeled pocket.

Figure 6:
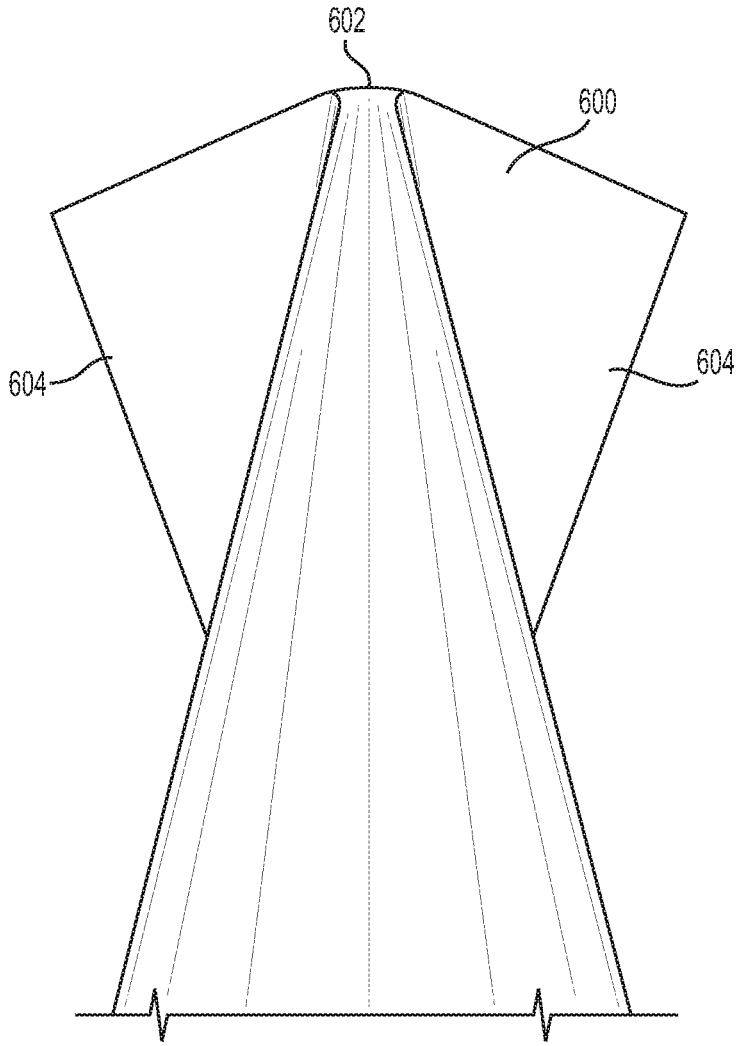
FIG. 6 is a schematic diagram that illustrates a piece of rectangular paper, representing a continuous, rectangular-shaped mesh material that would be attached to a lacrosse head, according to an embodiment.

To further illustrate the channel-forming characteristics of the present embodiments, FIG. 6 depicts a piece of rectangular paper 600, representing a continuous, rectangular-shaped mesh material that would be attached to a lacrosse head. In embodiments, a lacrosse head may be widest at the forward portion of the head, with the stringing cords pulling the first row of mesh openings (e.g., diamonds or hexagons) up against the rearward (or bottom) edge of the scoop, and with the outer mesh openings stretching out to the widest point of the head, as seen in FIG. 3, for example. The greater the arc length between the widest point of the head (or whichever stringing holes are used to tie the top stringing cord), the farther the first row of mesh openings must be stretched. As represented by the paper in FIG. 6, by arching a top portion 602 of the rectangular paper 600, and pinning the sides 604 of the rectangular paper 600 flat (as would be the case within a lacrosse head), a channel is formed in the center of the rectangular paper 600. In the present embodiments, attaching a mesh material to a lacrosse head with a forwardly offset stringing hole and a forwardly recessed portion, may provide the same channeling effect.

To further accentuate this channel effect, embodiments may provide a lacrosse head frame shape configured to increase tension on a mesh material. For example, a frame may be pointed at its forward portion, more arched at the scoop, and may transition from very wide shoulders of a scoop, to a very narrow, or pinched, sidewall configuration in the middle or rearward portion of the frame. This configuration of the frame may enhance the channel-forming effect.

Referring to FIG. 5, in one embodiment, the arc length of rearward edge 316 between the widest points 326 at the shoulders 327 is approximately 204.50 mm (including the perimeter along the rearward edge 316 through the recessed portion 318), and the longitudinal distance 328 between the widest point and the rearward edge 316 at the recessed portion 318 is approximately 56.86 mm. As shown in FIG. 5, recessed portion 318 provides an increased perimeter length of rearward edge 316 compared to a continuously arc-shaped rearward edge as represented by the broken line 319.

Figure 7:
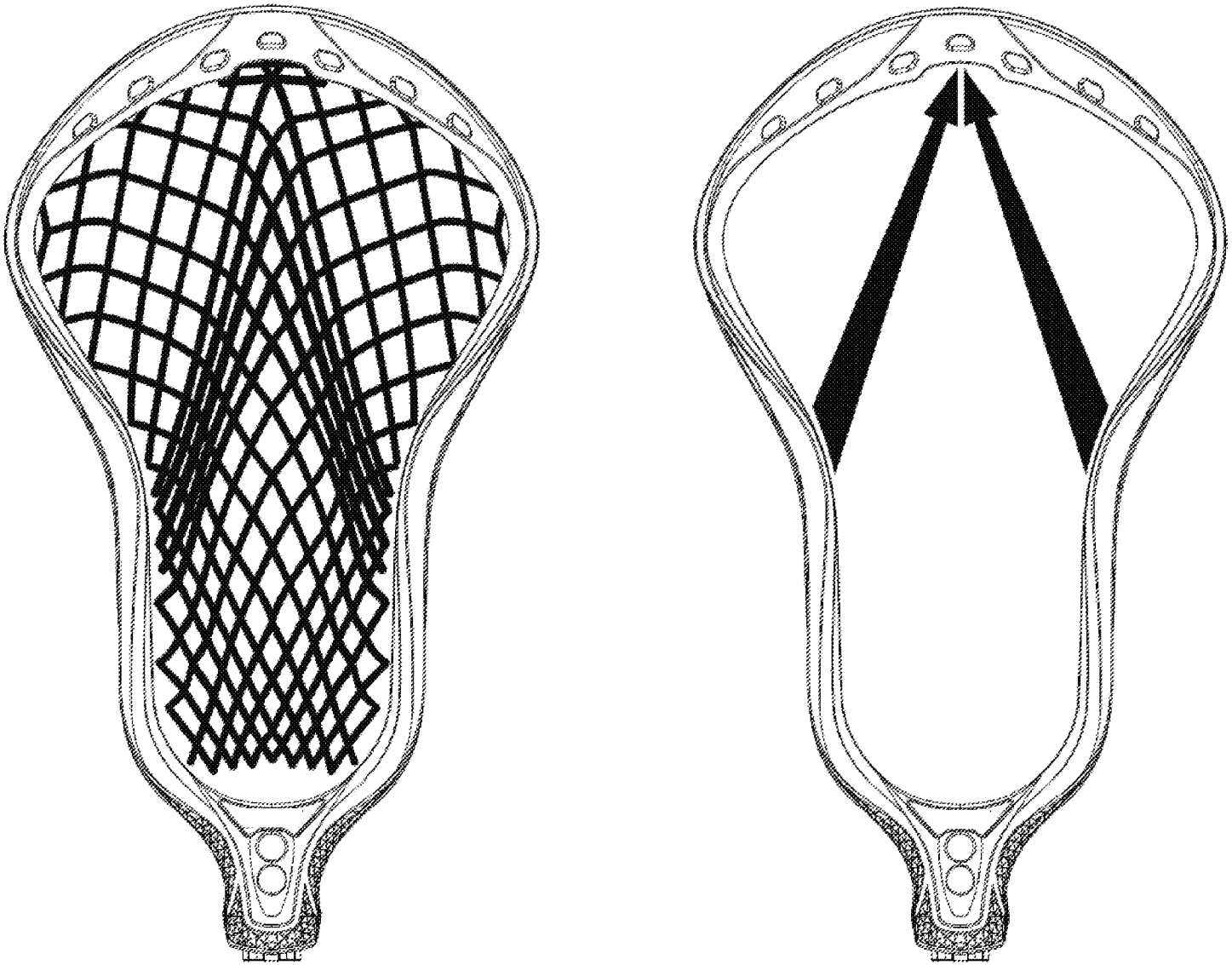
FIGS. 7-8 are schematic diagrams illustrating a channel-forming effect graphically, according to an embodiment.
Figure 8:
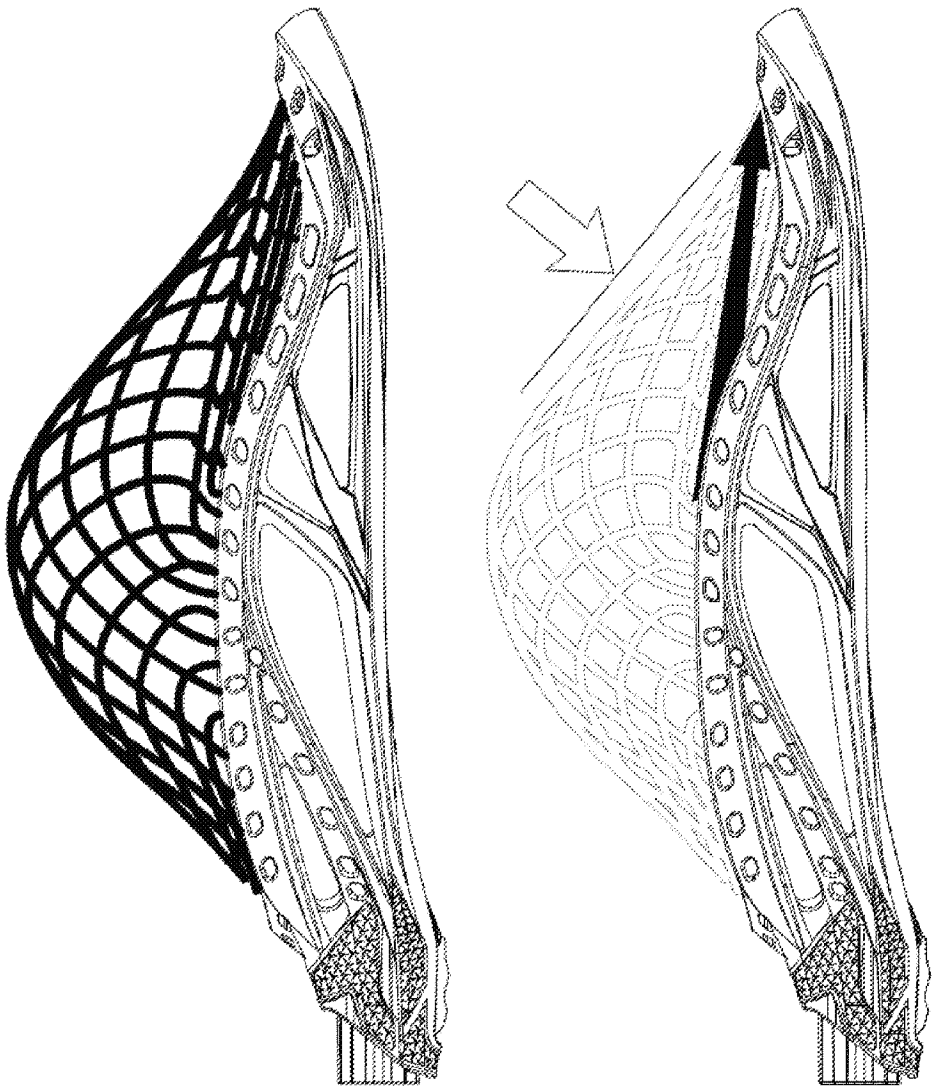

FIGS. 7-8 illustrate the channel-forming effect graphically. In embodiments, mesh may be strung tightly across the scoop portion of the lacrosse head. The sides of the mesh may then be stretched as much as possible down to the halfway point of the head. The sidewalls are closer together at the midpoint of the head, which may cause a depth in the mesh with a channeled shape. This phenomenon is demonstrated in the embodiment of FIG. 6, which illustrates of an 8"×11" piece of paper that is displaced in the same fashion as the mesh in a lacrosse head. The greatest amount of tension in the mesh may occur between the middle of the scoop and the midpoint of the sidewall to which the mesh is stretched. FIG. 7 displays an embodiment of the direction of tension between the middle scoop and middle sidewall. FIG. 7 also depicts an embodiment of a lacrosse head strung with a mesh pocket that has a well-defined channel. Stringing the pocket in such a way may cause obvious stretch and distortion in the mesh that is appealing to the experienced stringer, as it shows that the structure of the pocket is very deliberate. The definition of the channel may be directly related to the tension that is achieved between these two points. By utilizing the scoop feature embodiments described herein, a user can tension mesh into the recess of the scoop, which may add additional tension to the pocket. Pockets strung without using these features may have less definition and shape to their channel, especially closer to the scoop.

FIG. 8 depicts the side view of the same pocket configuration that is shown in FIG. 7, according to an embodiment. While the pocket in FIG. 8 has a very tensioned upper half, the silhouette of the pocket from the side is still very round without any abrupt changes in shape. This shape may provide smooth and consistent release of the ball during passing and shooting. In embodiments, a tight "V" shape achieved by the channel may help prevent the ball from becoming dislodged during catching and cradling. This type of "V" shape was previously achieved by stringing a "V"

shaped shooter. However, recent rule changes prevent players from utilizing a "V" shooter configuration.

As described above, embodiments may form a tensioned pocket channel by pulling a portion of mesh material of a pocket into a recessed portion of a scoop, farther forward than the remaining portion of the pocket mesh material. In embodiments, such as in FIG. 3, the pocket mesh material may be pulled by one or more stringing cords 308 attached to single offset stringing hole 312 generally centered with respect to longitudinal centerline 314 and disposed forward of remaining stringing holes 310 and recessed portion 318. Other embodiments may achieve a similar tension on the pocket mesh material.

Figure 9:
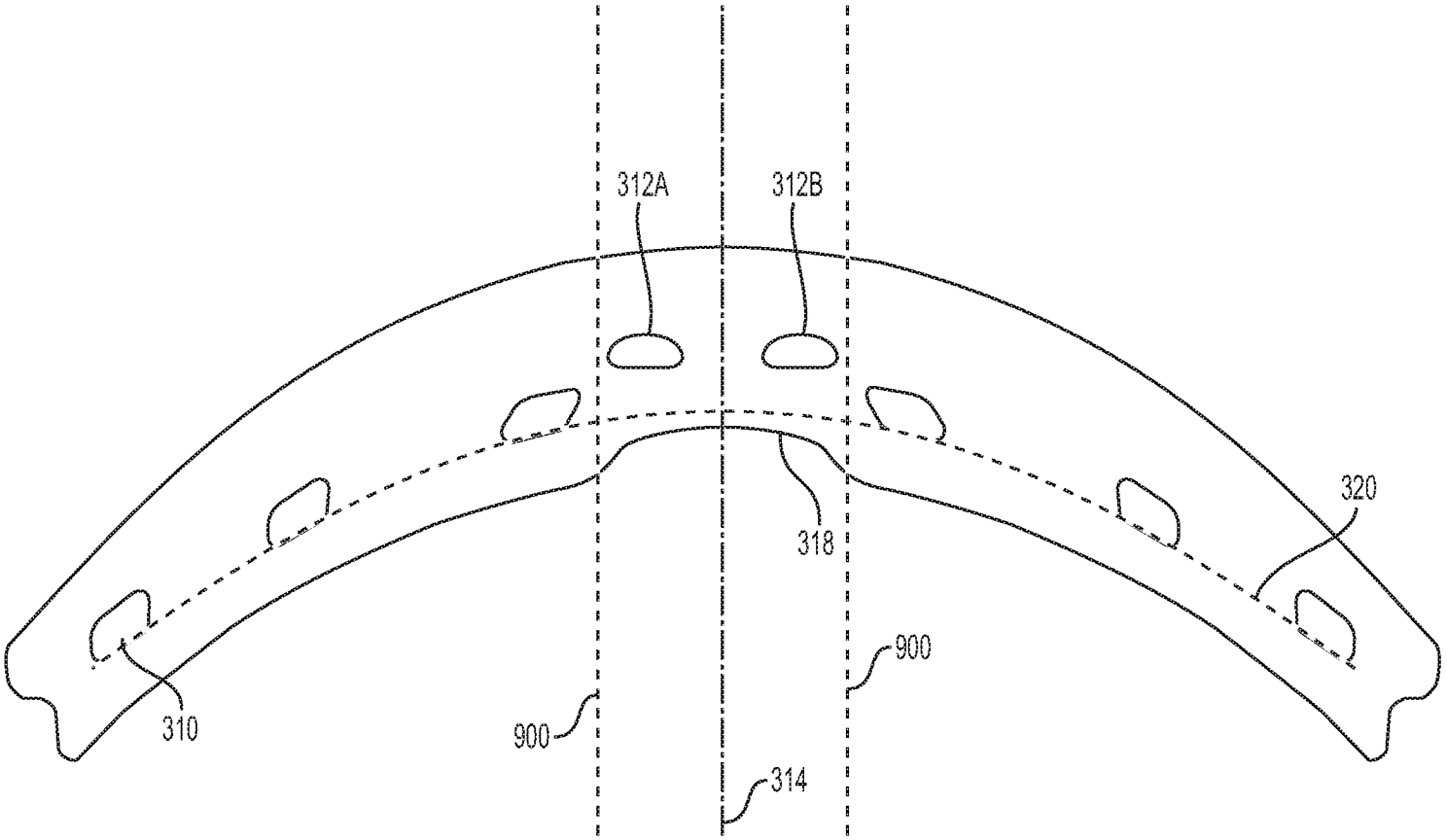
FIG. 9 is a schematic diagram that illustrates another embodiment of a lacrosse stick head configured to provide a channeled pocket.

For example, as shown in FIG. 9, embodiments may include two or more offset stringing holes 312A and 312B offset in a forward direction with respect to an arc 320 along which the remaining stringing holes 310 are disposed. Offset stringing holes 312A and 312B may be disposed substantially equal distances forward of arc 320 and recessed portion 318, and may be disposed generally symmetrical about longitudinal centerline 314. To provide a desired pull with respect to recessed portion 318, the rearward most edges of offset stringing holes 312A and 312B, against which a stringing member would rest, may be disposed forward of the forwardmost edge of recessed portion 318. In addition, in embodiments, such as in FIG. 9, offset stringing holes 312A and 3126 may be disposed inside the ends of recessed portion 318 in a forward direction as represented by the broken lines 900, and may not extend laterally beyond the ends of recessed portion 318.

Additional numbers and configurations of offset stringing holes are possible, including more than two offset stringing holes disposed forward of the remaining stringing holes along arc 320. Embodiments may include a center offset stringing hole and one or more other offset stringing holes disposed lateral to the center stringing hole. The offset stringing holes may also be disposed at distances from the longitudinal centerline 314 greater than the exemplary distances shown in FIG. 9, and even beyond the ends of the recessed portion (in the left and right directions in FIG. 9), as long as the positions of the offset stringing holes provide a tension of the pocket mesh material that pulls a portion of the pocket mesh material farther forward than the remaining portion of the pocket material. Thus, notwithstanding the particular benefits associated with the configurations described herein, the present embodiments should be considered broadly applicable to any number and positions of offset stringing holes that provide the desired tension on a pocket mesh material and form the desired pocket channel.

Embodiments may provide additional structural features of a lacrosse head scoop that may work in conjunction with a channeled pocket to direct a lacrosse ball out of and into a lacrosse head. In an embodiment, FIG. 10 illustrates a scoop 303 having a raised region 330 (or launch/landing pad region) that provides a raised surface in comparison to adjacent recessed regions 332. As represented graphically by the stippled shading in FIG. 10, raised region 330 may have a generally trapezoidal shape and may be generally aligned with the recessed portion 318 and the channel of the pocket, along the longitudinal centerline 314, so that the raised region 330 directs a lacrosse ball in and out of the lacrosse head in a direction generally aligned with the channeled pocket, to improve throwing accuracy and scooping. To enhance this centering effect, the raised region 330 may have side edges 334 that are raised in comparison to a center area 336 of the raised region 330. Alternatively, side edges 334 may not be raised and the entire raised region 330 may be substantially flat. The side edges 334 may extend generally diagonally from the rearward edge 316 of the scoop 303 to the forward edge 338 of the scoop 303 in a direction toward the longitudinal centerline 314, as shown in FIG. 10. The recessed regions 332 may help reduce the weight of a lacrosse head frame. In embodiments, scoop 303 may be monolithic such that raised region 330 and recessed regions 332 are formed from the same material, along with remaining portions of scoop 303. Alternatively, raised region 330 may be formed from a material different from remaining portions of scoop 303.

A raised region, such as raised region 330, may allow for a smooth release of the ball in the center of the scoop. The additional material of the raised region may also strengthen the middle of the scoop, which may be helpful to counteract stress incurred by that region of the scoop, e.g., when the pocket pulls that region. A forwardly offset stringing hole may be disposed along approximately the longitudinal and lateral midpoint of the raised region 330 to provide thicker, structurally supportive material around the hole. The recessed regions to the sides of the raised region may reduce weight, and add some flex to the areas of the scoop that do not experience as much stress from the stringing.

Embodiments of lacrosse heads disclosed herein may be injection-molded, monolithic structures. Other embodiments may be multi-component molded structures.

Examples of suitable materials for a lacrosse head according to the present embodiments include nylon, composite materials, elastomers, metal, urethane, polycarbonate, polyethylene, polypropylene, polyketone, polybutylene terephalate, acetals (e.g., Delrin™ by DuPont), acrylonitrile-butadiene-styrene (ABS), acrylic, acrylic-styrene-acrylonitrile (ASA), alcryn (partially crosslinked halogenated polyolefin alloy), styrene-butadiene-styrene, styrene-ethylene-butylene styrene, thermoplastic olefinic (TPO), thermoplastic vulcanizate (TPV), ethylene-propylene rubber (EPDM), and polyvinyl chloride (PVC).

For purposes of convenience various directional adjectives are used in describing the embodiments. For example, the description may refer to the top, bottom, and side portions or surfaces of a component. It may be appreciated that these are only intended to be relative terms and, for example, the top and bottom portions may not always be aligned with vertical up and down directions depending on the orientation of a component or lacrosse stick.

The foregoing disclosure of the preferred embodiments has been presented for purposes of illustration and description. It is not intended to be exhaustive or to limit the embodiments to the precise forms disclosed. Many variations and modifications of the embodiments described herein will be apparent to one of ordinary skill in the art in light of the above disclosure.

While various embodiments have been described, the description is intended to be exemplary, rather than limiting, and it will be apparent to those of ordinary skill in the art that many more embodiments and implementations are possible that are within the scope of the embodiments. Any feature of any embodiment may be used in combination with or substituted for any other feature or element in any other embodiment unless specifically restricted. Accordingly, the embodiments are not to be restricted except in light of the attached claims and their equivalents. Also, various modifications and changes may be made within the scope of the attached claims.

Further, in describing representative embodiments, the specification may have presented a method and/or process as a particular sequence of steps. However, to the extent that the method or process does not rely on the particular order of steps set forth herein, the method or process should not be limited to the particular sequence of steps described. As one of ordinary skill in the art would appreciate, other sequences of steps may be possible. Therefore, the particular order of the steps set forth in the specification should not be construed as limitations on the claims. In addition, the claims directed to the method and/or process should not be limited to the performance of their steps in the order written, and one skilled in the art can readily appreciate that the sequences may be varied and still remain within the spirit and scope of the present embodiments.

What is claimed is:

1. A lacrosse head, comprising:

a stop member;

a first sidewall extending from the stop member in a forward direction;

a second sidewall extending from the stop member in the forward direction; and a scoop connecting the first sidewall and the second sidewall opposite to the stop member, wherein the scoop has a forward edge and a rearward edge, wherein the rearward edge of the scoop defines generally an arc shape, except for a recessed portion spanning a longitudinal centerline of the lacrosse head, wherein the recessed portion has a first end defining a first longitudinal line generally parallel to the longitudinal centerline and a second end defining a second longitudinal line generally parallel to the longitudinal centerline, wherein a width of the recessed portion measured in a lateral direction perpendicular to the longitudinal centerline from the first end to the second end, is narrower than a width of the stop member measured in the lateral direction between the first sidewall and the second sidewall, wherein the scoop defines:

at least one forward stringing hole disposed forward of the recessed portion and entirely between the first longitudinal line and the second longitudinal line, a first lateral stringing hole disposed entirely beyond the first longitudinal line on a first side of the longitudinal centerline, and a second lateral stringing hole disposed entirely beyond the second longitudinal line on a second side of the longitudinal centerline opposite to the first side, and wherein the first lateral stringing hole and the second lateral stringing hole are configured to hold a pocket stringing member more rearward relative to the at least one forward stringing hole such that the at least one forward stringing hole is configured to pull a portion of a pocket strung to the lacrosse head into the recessed portion and more forward of portions of the pocket strung to the first lateral stringing hole and to the second lateral stringing hole.

2. The lacrosse head of claim 1, wherein a rearwardmost edge of the first lateral stringing hole and a rearwardmost edge of the second lateral stringing hole are disposed generally along a second arc shape that matches the arc shape of the rearward edge of the scoop.

3. The lacrosse head of claim 2, wherein the second arc shape extends between a rearwardmost edge of the at least one forward stringing hole and a forwardmost edge of the recessed portion.

4. The lacrosse head of claim 1, wherein the at least one forward stringing hole is centered over the longitudinal centerline of the lacrosse head.

5. The lacrosse head of claim 1, further comprising a pocket stringing member and a pocket.

6. The lacrosse head of claim 5, wherein the at least one forward stringing hole tensions the pocket along the longitudinal centerline, along a first diagonal direction from the recessed portion to a middle portion of the first sidewall between the scoop and the stop member, and along a second diagonal direction from the recessed portion to a middle portion of the second sidewall between the scoop and the stop member, thereby forming a channeled pocket along the longitudinal centerline of the lacrosse head.

7. The lacrosse head of claim 6, wherein the pocket comprises a mesh material and the pocket stringing member comprises one or more stringing cords that attach the mesh material to the first lateral stringing hole, the second lateral stringing hole, and the at least one forward stringing hole.

8. The lacrosse head of claim 1, wherein the at least one forward stringing hole comprises a first stringing hole and a second stringing hole disposed generally symmetrical about the longitudinal centerline.

9. The lacrosse head of claim 1, wherein measured in directions parallel to the longitudinal centerline, a first distance between a rearwardmost edge of the first lateral stringing hole and the rearward edge of the scoop, a second distance between a rearwardmost edge of the second lateral stringing hole and the rearward edge of the scoop, and a third distance between a rearwardmost edge of the at least one forward stringing hole and the rearward edge of the scoop are substantially equal.

10. The lacrosse head of claim 1, wherein, when viewed from a front view, a first line drawn from a middle portion of the first sidewall to the first end of the recessed portion intersects the longitudinal centerline forward of the first end, and a second line drawn from a middle portion of the second sidewall to the second end of the recessed portion intersects the longitudinal centerline forward of the second end.

11. The lacrosse head of claim 1, wherein the lacrosse head defines a minimum width between the first sidewall and the second sidewall measured in a lateral direction perpendicular to the longitudinal centerline, and wherein a recessed portion width measured from the first longitudinal line to the second longitudinal line in the lateral direction is less than the minimum width.

12. The lacrosse head of claim 11, further comprising a juncture configured to receive a handle extending along the longitudinal centerline, and wherein the recessed portion width is greater than a width of a handle received in the juncture measured in the lateral direction.

13. The lacrosse head of claim 1, further comprising a handle secured to the lacrosse head.

14. The lacrosse head of claim 1, wherein a forwardmost edge of the recessed portion is forward of a rearwardmost edge of the first lateral stringing hole and a rearwardmost edge of the second lateral stringing hole.

15. A lacrosse head, comprising:

a stop member;

a first sidewall extending from the stop member in a forward direction;

a second sidewall extending from the stop member in the forward direction;

a scoop connecting the first sidewall and the second sidewall opposite to the stop member, wherein the scoop has a forward edge and a rearward edge, wherein the rearward edge of the scoop defines generally a first arc shape, except for a recessed portion that spans a longitudinal centerline of the lacrosse head and is recessed with respect to a first lateral portion of the rearward edge on a first side of the longitudinal centerline and a second lateral portion of the rearward edge on a second side of the longitudinal centerline opposite to the first side, wherein the recessed portion extends from a first end at the first side to a second end at the second side, wherein the lacrosse head defines a minimum width between the first sidewall and the second sidewall measured in a lateral direction perpendicular to the longitudinal centerline, wherein the recessed portion extends from the first end to the second end a recessed portion width measured in the lateral direction, wherein the recessed portion width is less than the minimum width, wherein the scoop defines:

at least one forward stringing opening spanning the longitudinal centerline and disposed forward of the recessed portion, and a plurality of lateral stringing openings disposed generally along a second arc shape substantially similar to the first arc shape, wherein among the plurality of lateral stringing openings, a first lateral stringing opening is disposed closest to the first end of the recessed portion and a second lateral stringing opening is disposed closest to the second end of the recessed portion, wherein the first lateral stringing opening is disposed laterally beyond the recessed portion and adjacent to the first lateral portion of the rearward edge, and wherein the second lateral stringing opening is disposed laterally beyond the recessed portion and adjacent to the second lateral portion of the rearward edge; and a pocket attached to the at least one forward stringing opening, to the first lateral stringing opening, to the second lateral stringing opening, to the first sidewall, to the second sidewall, and to the stop member, wherein attachment of the pocket to the at least one forward stringing opening pulls a central portion of the pocket more forward of remaining forward portions of the pocket that are attached to the first and second lateral stringing openings, and tensions the pocket in a longitudinal direction from the scoop to the stop member, in a first diagonal direction from the recessed portion to the first sidewall, and in a second diagonal direction from the recessed portion to the second sidewall, thereby forming a channel in the pocket.

16. The lacrosse head of claim 15, wherein the first diagonal direction extends from the recessed portion of the scoop to at least as rearward as a middle portion of the first sidewall, and wherein the second diagonal direction extends from the recessed portion to at least as rearward as a middle portion of the second sidewall.

17. The lacrosse head of claim 15, wherein the stop member has a stop member width measured in the lateral direction between the first sidewall and the second sidewall, and wherein the recessed portion width is less than the stop member width.

18. The lacrosse head of claim 15, further comprising a juncture configured to receive a handle extending along the longitudinal centerline, and wherein the recessed portion width of the recessed portion is wider than a width of a handle received in the juncture, measured in the lateral direction.

19. The lacrosse head of claim 15, wherein the first end of the recessed portion defines a first longitudinal line generally parallel to the longitudinal centerline and the second end of the recessed portion defines a second longitudinal line generally parallel to the longitudinal centerline, and wherein the at least one forward stringing opening is disposed entirely between the first longitudinal line and the second longitudinal line.

20. A lacrosse head, comprising:

a frame extending from a rearward end to a forward end and defining a longitudinal centerline of the lacrosse head, wherein the rearward end of the frame includes a stop member extending laterally across the longitudinal centerline between a first sidewall and a second sidewall, wherein the forward end of the frame includes a scoop having a forward edge and a rearward edge, wherein the scoop defines:

a forward stringing opening disposed over the longitudinal centerline, with a first rearwardmost edge of the forward stringing opening configured to support a pocket stringing member, a first lateral stringing opening disposed on a first side of the longitudinal centerline, with a second rearwardmost edge of the first lateral stringing opening configured to support a pocket stringing member, and a second lateral stringing opening disposed on a second side of the longitudinal centerline opposite to the first side, with a third rearwardmost edge of the second lateral stringing opening configured to support a pocket stringing member, wherein the first rearwardmost edge is forward of the second rearwardmost edge and the third rearwardmost edge, wherein the rearward edge of the scoop defines a recessed portion recessed in the forward direction, wherein the recessed portion extends laterally over the longitudinal centerline from a first end on the first side to a second end of the second side, wherein the first end is laterally inside of the second rearwardmost edge of the first lateral stringing opening and the second end is laterally inside of the third rearwardmost edge of the second lateral stringing opening, and wherein a width of the recessed portion measured in a lateral direction perpendicular to the longitudinal centerline from the first end to the second end, is narrower than a width of the stop member measured in the lateral direction between the first sidewall and the second sidewall.

* * * * *